US005355566A

United States Patent [19]

Eglseer et al.

[11] Patent Number: 5,355,566

[45] Date of Patent: Oct. 18, 1994

[54] MACHINE FOR THE AUTOMATIC DRAWING-IN OF WARP THREADS

[75] Inventors: Hermann Eglseer, Uster; Hans Wilhelm, Chur, both of Switzerland

[73] Assignee: Zellweger Uster AG, Uster, Switzerland

[21] Appl. No.: 867,189

[22] PCT Filed: Nov. 12, 1991

[86] PCT No.: PCT/CH91/00229

§ 371 Date: Jul. 1, 1992

§ 102(e) Date: Jul. 1, 1992

[87] PCT Pub. No.: WO92/08830

PCT Pub. Date: May 29, 1992

[30] Foreign Application Priority Data

Nov. 14, 1990 [CH] Switzerland ..... 3619/90-1

[51] Int. Cl.[5] ..... B65H 67/00

[52] U.S. Cl. ..... 28/202; 28/203.1

[58] Field of Search ..... 28/201, 202, 203, 204, 28/205, 206, 207

[56] References Cited

U.S. PATENT DOCUMENTS

| | | | |
|---|---|---|---|
| 4,910,837 | 3/1990 | Fujimoto et al. | 28/202 X |
| 5,099,555 | 3/1992 | Okuda | 28/202 X |
| 5,134,759 | 8/1992 | Hacker et al. | 28/202 |

*Primary Examiner*—Clifford D. Crowder
*Assistant Examiner*—Larry D. Worrell, Jr.
*Attorney, Agent, or Firm*—Burns, Doane, Swecker & Mathis

[57] ABSTRACT

The drawing-in machine contains a drawing-in frame having a clamped warp-thread layer, a selecting member for selecting the individual warp threads of the warp-thread layer, and an apparatus for presenting the selected warp threads to a drawing-in member. The apparatus for presenting the warp threads has a transport clamp (31) of adjustable stroke for the controlled transport of the separated thread end to a position to be received by the drawing-in member, a guide element (32) for controlling the thread during the transport operation and a thread holding device (21) for controlling the thread during the drawing-in. Full control of the thread is thereby ensured, and faults are largely eliminated.

10 Claims, 4 Drawing Sheets

MACHINE FOR THE AUTOMATIC DRAWING-IN OF WARP THREADS

The present invention relates to a machine for the automatic drawing-in of warp threads into the harness of a weaving machine from a warp-thread layer, having an apparatus for selecting the individual warp threads of the warp-thread layer, which apparatus has a separating member, and an apparatus for presenting the selected warp threads to a drawing-in member.

BACKGROUND OF THE INVENTION

In the drawing-in machine USTER DELTA (USTER being a registered trademark of Zellweger Uster AG) described in U.S. Pat. No. 3,681,825, the selected warp threads are presented by first being laterally deflected in the plane of the warp-thread layer and then being pressed by a finger-like member into a position in which they are received by the drawing-in member. This finger-like member is adjustable in stroke in the longitudinal direction of the warp threads. In this arrangement, the thread is held at its cut-off top end by a clamp. During the presentation, the thread is clamped between its bottom end, held by a clamping rail of the drawing-in frame, and its top end, held by the said clamp. The finger-like member presses laterally against the clamped thread and slides along the latter.

As soon as the drawing-in member, formed by a hook, has taken hold of the thread presented to it, the top clamp opens and the thread falls downwards in an uncontrolled manner. At the same time, the thread is drawn in, the drawing-in taking place as a so-called "loop drawing-in".

For several reasons, this known type of thread presentation is in need of improvement. On the one hand, the positioning of the thread in the receiving position by the finger-like member sliding along the thread is not very gentle on the thread and can possibly lead to breaking of the thread. Then the thread falling downwards in an uncontrolled manner can get caught, which would likewise lead to a fault. Finally, since a plurality of threads cannot of course fall downwards at the same time, the drawing-in frequency and thus the working speed of the drawing-in machine are limited.

SUMMARY OF THE INVENTION

An object of the invention is to provide an apparatus for thread presentation which treats the thread as gently as possible and ensures full control of the thread. Another object of the invention is to provide apparatus in which a higher drawing-in frequency is possible.

These objects are achieved according to the invention in an apparatus for presenting the warp threads which has a drivable transport clamp for the controlled transport of each separated thread end to a position to be received by the drawing-in member as well as first means for controlling the thread during the transport operation.

Unlike the known presentation apparatus, the thread does not fall freely downwards after the separation. Instead, it is transported downwards in a positive manner by the transport clamp. Since the thread is fully under control over its entire length in the process, faults caused by the thread getting caught are impossible. The use of the transport clamp opens up the possibility of transporting a plurality of threads simultaneously in a staggered manner to the receiving position and of thereby increasing the drawing-in frequency.

A preferred embodiment of the apparatus according to the invention is characterised by controlled positioning means, arranged at the receiving position, for the thread in the area of its separated end, and by second means for controlling the thread during the drawing-in.

BRIEF DESCRIPTION OF THE DRAWINGS

The invention is described in greater detail below with reference to an exemplary embodiment and the drawings, in which.

DETAILED DESCRIPTION OF ILLUSTRATED EMBODIMENTS

Figure 1:
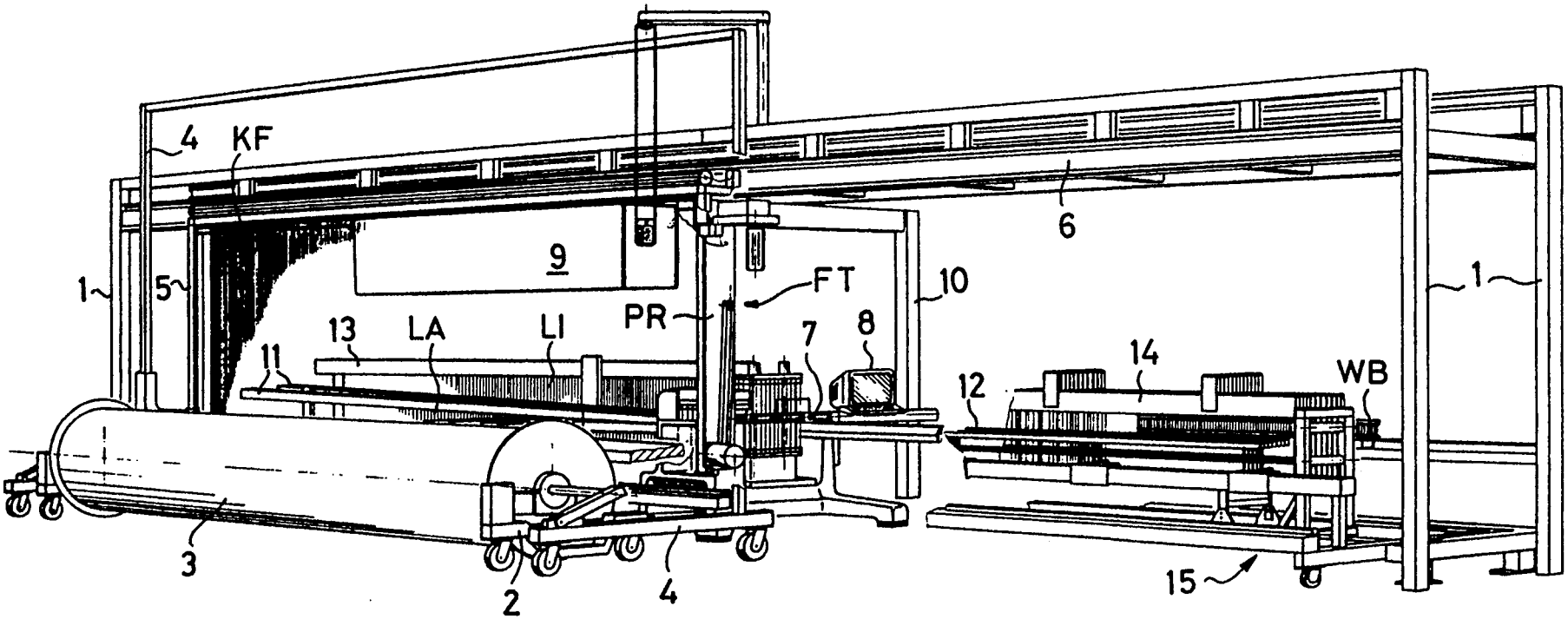
FIG. 1 shows a perspective overall representation of a drawing-in machine according to the invention.

According to FIG. 1, the drawing-in machine consists of a mounting stand 1 and various subassemblies arranged in this mounting stand 1. Each of these subassemblies represents a functional module. A warp-beam truck 2 with a warp beam 3 arranged thereon can be recognised in front of the mounting stand 1. The warp-beam truck 2 is coupled via the warp beam 3 to an apparatus, designated below as lifting device 4, for receiving and holding a drawing-in frame 5 on which the warp threads KF are clamped. This clamping is effected before the actual drawing-in and at a location separate from the drawing-in machine, the drawing-in frame 5 being positioned at the bottom end of the lifting device 4 directly next to the warp beam 3. For the drawing-in, the warp-beam truck 2 together with warp beach 3 and lifting device 4 is moved to the so-called setting-up side of the drawing-in machine and the drawing-in frame 5 is lifted up by the lifting device 4 and hung in the mounting stand 1, where it then assumes the position shown. The frame 5 is hung in a transport apparatus (not shown) mounted on the front top longitudinal girder 6 of the mounting stand 1.

During the drawing-in process, the frame 5 and the lifting device 4 together with the warp-beam truck 2 and the warp beam 3 are displaced from left to right in the longitudinal direction of the girder 6. During this displacement, the warp threads KF are directed past a thread-separating stage FT which has an apparatus for selecting the warp threads and for cutting off the selected warp threads KF as well as an apparatus PR for presenting the cut-off warp threads to a drawing-in needle 7, which needle forms a component of the so-called drawing-in module. The selecting apparatus used in the warp tying machine USTER TOPMATIC can be used, for example, for the selection of the warp threads.

Next to the drawing-in needle 7 can be recognised a video display unit 8, which belongs to an operating station and serves to display machine functions and machine malfunctions and to input data. The operating station, which forms part of a so-called programming module, also contains an input stage for the manual input of certain functions, such as, for example, creep motion, start/stop, repetition of operations, and the like. The drawing-in machine is controlled by a control module which contains a control computer and is arranged in a control box 9. Apart from the control computer, this control box contains a module computer for every so-called main module, the individual module computers being controlled and monitored by the control computer. The main modules of the drawing-in machine, apart from the modules already mentioned—drawing-in module, yarn module, control module and programming module—are the heald, drop-wire and reed modules.

The thread-separating stage FT, which presents the warp threads KF to be drawn in to the drawing-in needle 7, and the path of movement of the drawing-in needle 7, which runs vertically to the plane of the clamped warp threads KF, define a plane in the area of a support 10 forming part of the mounting stand, which plane separates the setting-up side already mentioned from the so-called taking-down side of the drawing-in machine. The warp threads and the individual elements into which the warp threads are to be drawn in are fed at the setting-up side, and the so-called harness (healds, drop wires and reed) together with the drawn-in warp threads can be removed at the taking-down side.

When all the warp threads KF are drawn in and the frame 5 is empty, the latter, together with the lifting device 4, the warp-beam truck 2 and the warp beam 3, is located on the taking-down side and can be removed from the mounting stand 1.

Arranged directly behind the plane of the warp threads KF are the warp-stop-motion drop wires LA, behind the latter the healds LI and further to the rear the reed. The drop wires La are stacked in hand magazines and the full hand magazines are hung in sloping feed rails 11, on which they are transported to the right towards the drawing-in needle 7. At this location they are separated and moved into the drawing-in position. Once drawing-in is complete, the drop wires LA pass on drop-wire supporting rails 12 to the taking-down side.

The healds LI are lined up on rails 13 and shifted on the latter to a separating stage. The healds LI are then moved individually into their drawing-in position and, once drawing-in is complete, are distributed over the corresponding heald shafts 14 on the taking-down side. The reed is likewise moved step-by-step passed the drawing-in needle 7, the corresponding reed gap being opened for the drawing-in. After the drawing-in, the reed is likewise located on the taking-down side. A part of the reed WB can be recognised to the right next to the heald shafts 14. This representation is to be understood purely as an illustration, since the reed, at the position shown of the frame 5, is of course located on the setting-up side.

As further apparent from the figure, a so-called harness truck 15 is provided on the taking-down side. This harness truck 15, together with the drop-wire supporting rails 12, fixed thereon, heald shafts 14 and a holder for the reed, is pushed into the mounting stand 1 into the position shown and, after the drawing-in, carries the harness having the drawn-in warp threads KF. At this moment, the lifting device 4 and the warp-beam truck 2 with the warp beam 3 are located directly in front of the harness truck 15. By means of the lifting device 4, the harness is now reloaded from the harness truck 15 onto the warp-beam truck 2, which then carries the warp beam 3 and the drawn-in harness and can be moved to the relevant weaving machine or into an intermediate store.

The individual main modules of the drawing-in machine are composed of submodules which are in each case provided for certain functions. But this modular construction is not the subject-matter of the present invention. Reference is made in this connection to Swiss Patent Application No. 3633/89. The submodule PR presenting the selected warp threads to the drawing-in needle 7 is now to be described below, which submodule PR forms part of the yarn module.

Figure 2A:
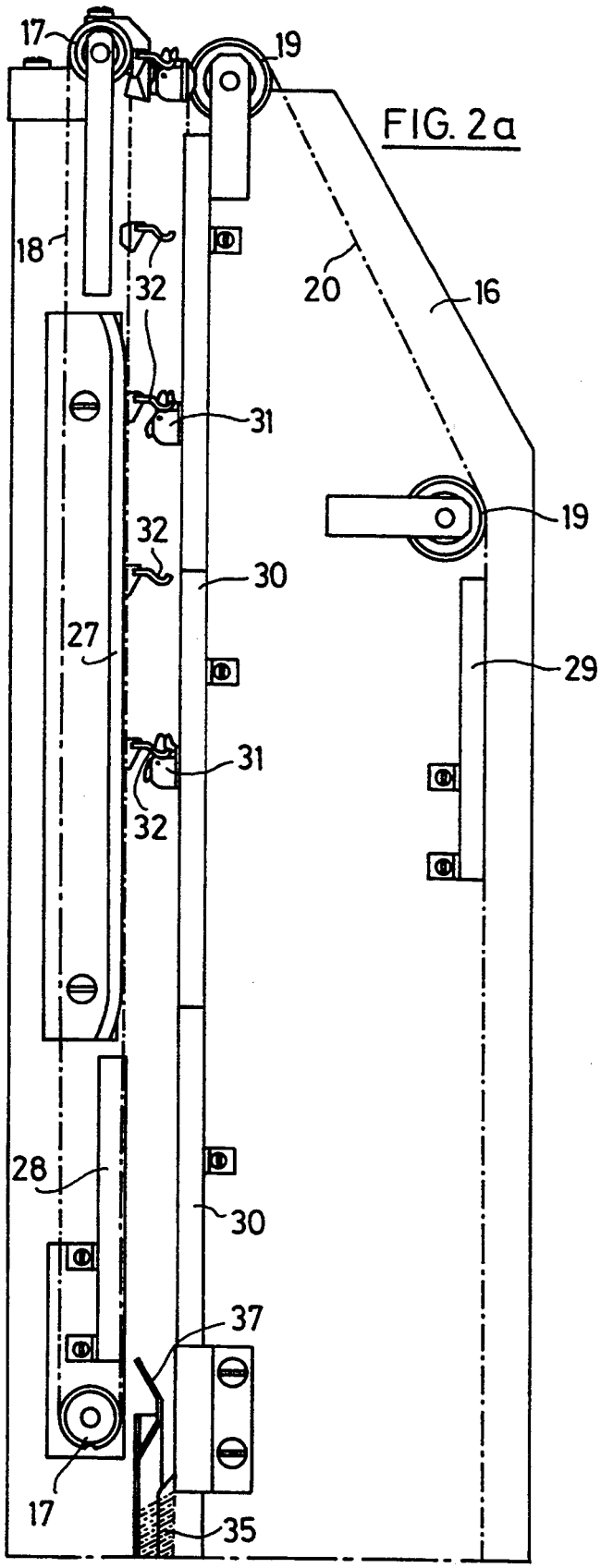
FIGS. 2*a* and 2*b* and 3*a* and 3*b* show a representation of the thread-presentation apparatus of the drawing-in machine of FIG. 1 in two views.
Figure 3A:
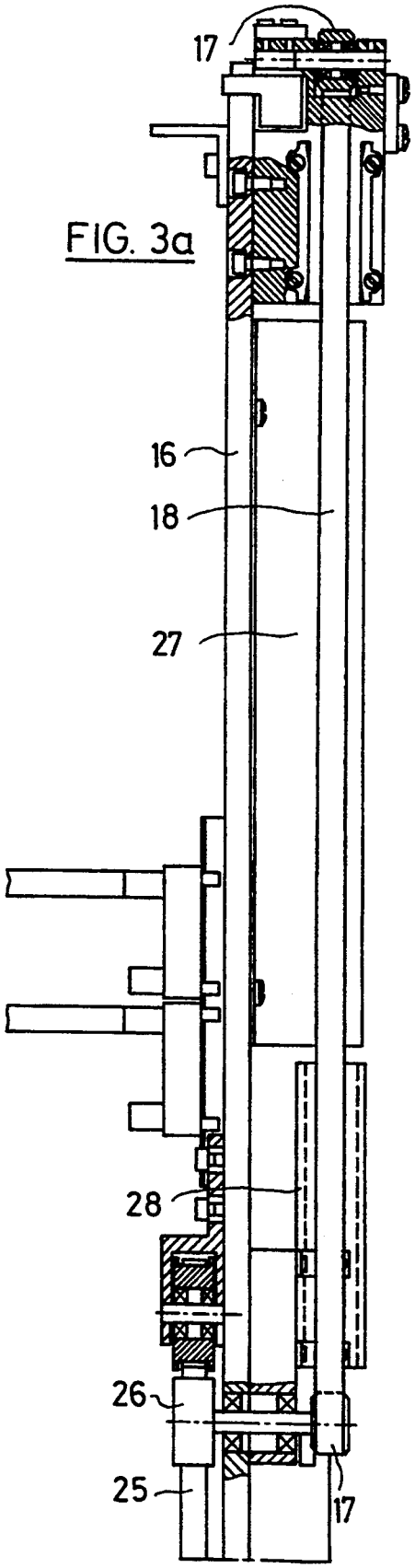
Figure 2B:
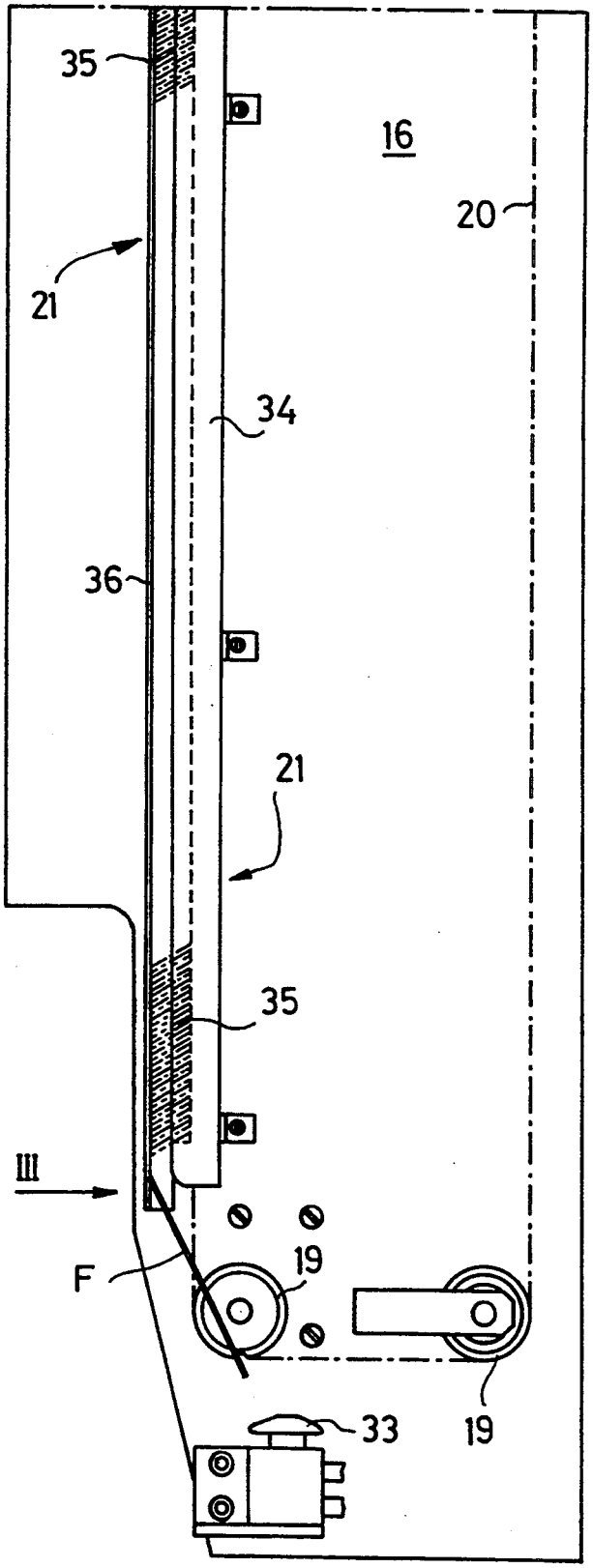

The entire yarn module consists essentially of the lifting device 4, the warp-beam truck 2, the drawing-in frame 5 with its transport apparatus and the thread-separating stage FT, of which the presentation apparatus PR forms a part. This submodule is shown in side view in FIGS. 2*a* and 2*b*, as seen from the left with regard to FIG. 1, and is shown in rear view in FIGS. 3*a* and 3*b* in the direction of arrow III in FIG. 2*b*. FIGS. 2*a* and 3*a* are each terminated at the bottom and FIGS. 2*b* and 3*b* are each terminated at the top by a dot-dash line and are to be imagined as being lined up at these terminating lines.

According to the representation, the presentation apparatus PR essentially comprises an elongated base plate 16 which is fastened to the mounting stand 1 (FIG. 1) and on which there are arranged first and second rollers 17 and 19 and a thread holding or retarding device 19. The first rollers 17 are for guiding and driving a guide belt 18 extending from the top down to about the centre of the base plate 16. The second rollers 19 are for guiding and driving a transport belt 20 extending over the entire length of the base plate 16. The thread-holding device 21 follows the guide belt 18, and extends downwardly. In addition, a thread-positioning stage is arranged in the area of the bottom return point of the transport belt 20. This thread-positioning stage is shown in FIG. 4 and is symbolised in FIGS. 2*b* and 3*b* by a thread piece F drawn in double lines.

Figure 3B:
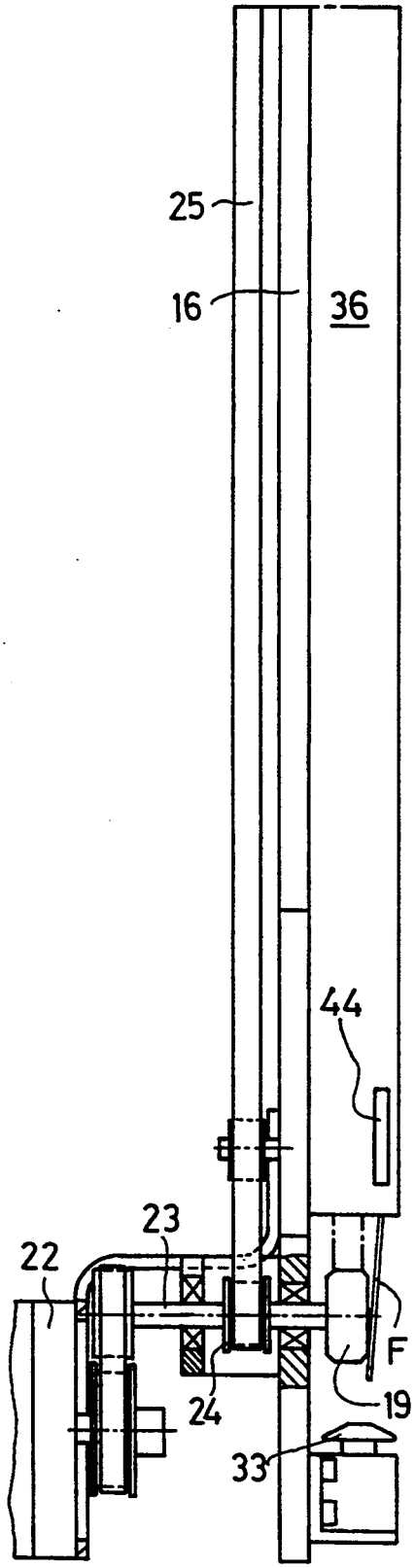
Figure 4:
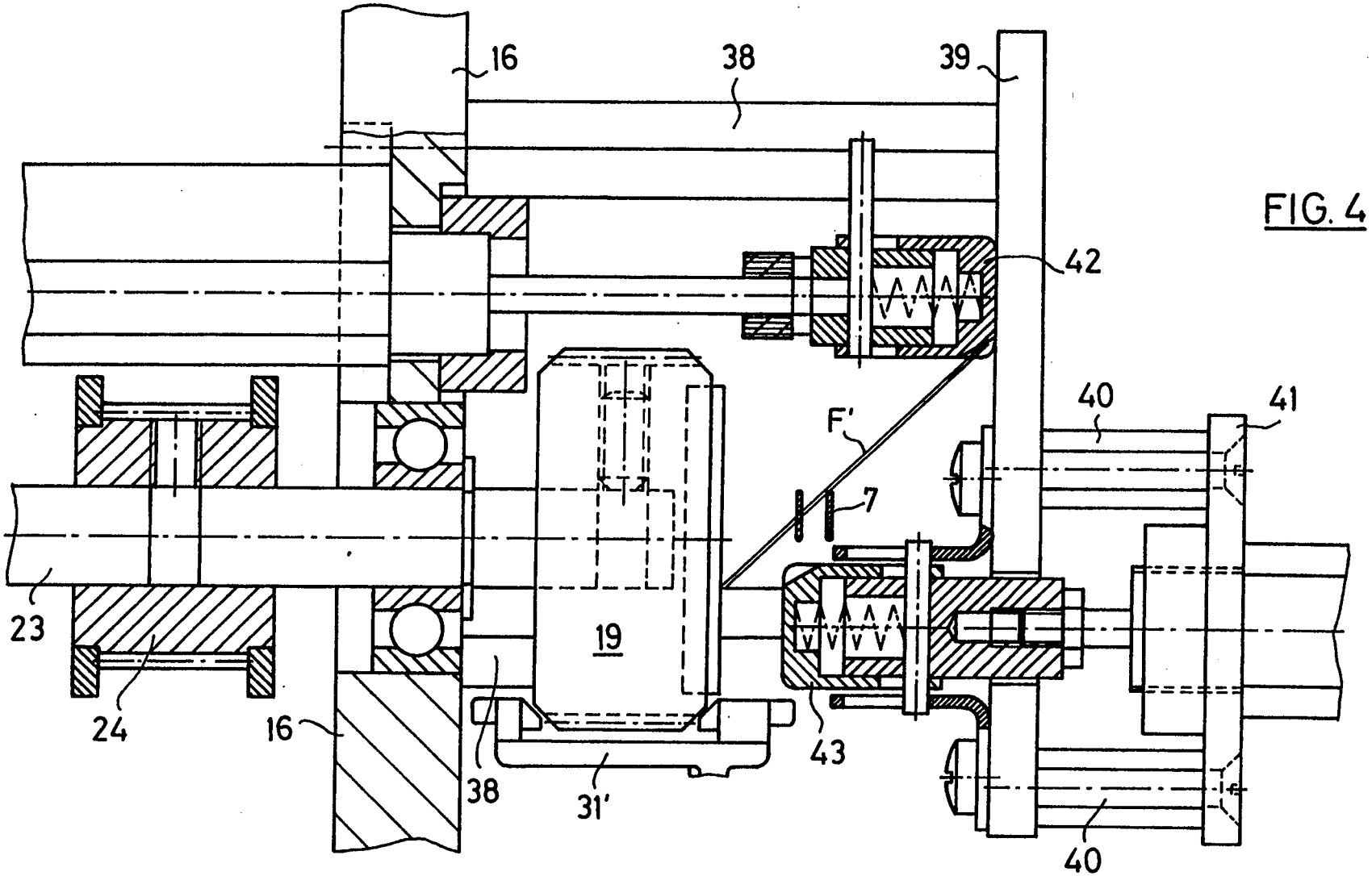
FIG. 4 shows a detail of FIG. 3*b*.

As apparent from FIGS. 3*a* and 3*b*, a motor 22 is fastened to the side of the base plate 16 remote from the belts 18 and 20. Each of the belts 18 and 20 is a toothed belt which the motor 22, via a further belt, drives a shaft 23 on which there is mounted on either side of the base plate 16 a roller 19 and 24, respectively. The right-hand roller 19 in FIG. 3*b* is the drive roller for the transport belt 20, and the left-hand roller 24 drives a toothed belt 25 which, via a roller 26 (FIG. 3*a*), drives the bottom roller 17 serving as a drive for the guide belt 18. The drive rollers at least are designed as toothed-belt pulleys.

The drive mechanism described ensures that transport and guide belts 20 and 18 respectively are driven at a constant speed ratio. A plurality of belt guides are arranged in the course of the path of the two belts 18 and 20. A guide rail like a bearing surface is designated by reference numeral 27, and a channel-like guide having laterally projecting margins for the guide belt 18 is designated by reference numeral 28. Reference numeral 29 designates a channel-like guide and reference numeral 30 designates a likewise channel-like guide rail for the transport belt 20.

The guide belt 18 is driven clockwise and the transport belt 20 is driven anticlockwise so that the two belts therefore run in the same direction from top to bottom in the area of the guide rails 27 and 30. Flexible transport clamps 31, of which only three are drawn in FIG. 2*a*, are arranged at regular distances along the transport belt 20. The mutual distance between the transport clamps 31 is 130 mm; accordingly, the entire length of the base plate 16 is slightly more than 1 meter. Deflection hooks 32, of which only five are drawn in FIG. 2*a*, are arranged along the guide belt 18 at half the spacing of the transport clamps 31, that is, at distances of 65 mm. As can be determined by re-measuring, eight transport clamps 31 and deflection hooks 32 always run simultaneously from top to bottom with the transport belt 20 and the guide belt 18 respectively.

When a warp thread is selected, it is clamped just as before the selecting between a top and a bottom clamping rail of the drawing-in frame 5 (FIG. 1) and, in this position, is offered in the area of the top clamping rail to the deflection hooks 32, whose path of movement it crosses. The thread is held in the area of the top clamping rail by a separating device (not shown), is cut and placed with the top end of the bottom part over the deflection hook 32 and is inserted into the open transport clamp 31; this position is shown at the top in FIG. 2*a*. The transport clamp 31 then closes and clamps the thread in place. At this moment, both belts 18 and 20 are at rest. Transport clamp 31 and deflection hook 32 are then moved downwards, the thread being clamped from the bottom clamping rail of the drawing-in frame 5 (FIG. 1) via the deflection hook 32 to the transport clamp 31. So that the thread now stays clamped during its transport, the transport clamp 31 runs twice as fast as the deflection hook 32, or, in other words, the transport belt 20 is driven twice as fast as the guide belt 18.

As soon as the next deflection hook 32 takes hold of the next selected thread, the operation described is repeated so that eight threads can thus always be transported simultaneously from top to bottom, and in fact in a staggered and intermittent manner. As soon as a transport clamp 31 has arrived in the area of the drive roller 19 at the bottom left in FIG. 2*b* (which takes place exactly at a moment when the transport belt 20 is at rest), the thread is transferred to the positioning stage shown in FIG. 4, the transport clamp 31 being opened by a pneumatic plunger 33. The drawing-in needle 7 (FIG. 1) then receives the thread.

The thread must definitely be released from its deflection hook 32 the moment it is received by the drawing-in needle 7, because the drawing-in takes place at a speed many times greater than the transport by the transport clamps 31. After the release by the deflection hook 32, the thread is controlled by the thread-holding device 21. The latter is the continuation of the guide rail 30 and it is designed like a guide channel or guide shaft. The front of this channel facing the viewer is covered by a strip 34 except for a slot. On its inside, this strip is provided with a bristle band 35, whose bristles extend up to a wall 36 laterally terminating the guide channel. Provided at the top end of the guide channel is a bow-like thread guide 37 which guides the thread from the deflection hook 32 into the thread-holding device 21. When it is being drawn out, the thread slides in this thread-holding device 21 between the wall 36 and the bristles bearing against this wall 36, both of which together act as a thread brake. Consequently, the thread is always clamped in this phase and never gets out of control. A window-like recess 44 for monitoring thread movement by a sensor is provided in the area of the bottom end of the wall 36.

FIG. 4 shows a view of the positioning stage in which the thread is positioned for being received by the drawing-in needle 7 (FIG. 1). The figure is an enlarged detail of FIG. 3*b*, the pneumatic plunger 33 for opening the transport clamps 31 being omitted for the sake of clarity. The bottom end of the base plate 16 and the shaft 23 having the rollers 24 and 19 will be recognised in the figure. Shown at the periphery of the roller 19 is a clamping element 31' which fastens the transport clamps 31 (FIG. 2*a*) to the transport belt 20.

A first support plate 39 is held at a distance from the base plate 16 via first distance pins 38. A a second support plate 41 is mounted on the first support plate 39 via second distance pins 40. In addition, the first support plate 39 serves as a stop for a first pneumatic clamping plunger 42 which is mounted in the base plate 16 and whose end face, in the inoperative state, lies at the level of the right-hand end face of the roller 19. When the plunger 42 is activated, it is moved to the right towards the first support plate 39 until it bears against the latter in its active position shown. Mounted in the second support plate 41 is a second pneumatic clamping plunger 43 which, when it is activated, is moved out of its inoperative position shown and to the left towards the roller 19 to bear against the stop at the adjacent end face of the latter.

As a comparison of FIGS. 3*b* and 4 shows, the thread in the position F, in which it is offered to the position stage, is inclined at a relatively slight angle and is then moved by the clamping plungers 42 and 43 into the receiving position F' drawn in FIG. 4, in which it is moved in the path of the schematically drawn drawing-in needle 7 and is taken hold of by its hook-shaped jaw and clamped in place in the latter.

As already mentioned, both the opening of the transport clamps 31 for releasing the thread and their closing during receiving of the thread are effected when the transport belt 20 is at rest. During the drawing-in by the drawing-in needle 7, the next transport clamp 31 reaches the pneumatic plunger 33 and a next thread is received, and so on. Since eight threads pass through the presenting apparatus PR simultaneously, eight times the drawing-in duration is available for this for one thread, so that reliable thread presentation is ensured even at high drawing-in frequency.

What is claimed is:

1. Machine for drawing warp threads into a harness for a weaving machine from a warp-thread layer; said machine comprising a drawing-in member movable back and forth along a path; a frame having top and bottom clamping rails for holding said warp thread layer, means for selecting individual warp threads of the warp-thread layer, a separating member for separating warp thread ends, said top clamping rail being mounted at a position adjacent to said separating member and said bottom clamping rail being mounted at a position adjacent to said drawing-in member; means for presenting the selected warp threads to said drawing-in member, said means for presenting the warp threads including a drivable transport clamp for transporting each separated warp thread end to a position to be received by said drawing-in member, a moveable guide element for controlling the thread during the transport operation, and means for driving said guide element in timed relation to be movement of said transport clamp, means for holding the separated thread in a fixed position in the path of said drawing-in member, and means for controlling the thread during the drawing-in, said transport clamp being movable downwardly from the level of said separating member to the level of said drawing-in member, said guide element being movable downwardly from the level of said separating member to a level above said drawing member along a path such that when said transport clamp transports a separated thread end downwardly, said thread end runs from the bottom clamping rail to the guide element and from the guide rail to the transport clamp.

2. Machine according to claim 1, wherein said guide element is hook-shaped and wherein said drive means drives said guide element at half the speed of said transport clamp.

3. Machine according to claim 2, including a plurality of spaced apart transport clamps and a plurality of spaced apart guide elements, said guide elements being spaced apart from one another a distance half as large as the distance between adjacent ones of said transport clamps.

4. Machine according to claim 3, including first and second drive belts mounted for movements along closed paths such that said first drive belt moves downwardly along a path facing a downwardly moving portion of said second drive belt, said transport clamps being mounted on said first drive belt, and said guide elements being mounted on said second drive belt.

5. Machine according to claim 4, wherein said downwardly moving portion of the path of movement of said second drive belt is shorter than said downwardly moving portion of the path of movement of said first drive belt, and wherein said means for controlling the thread during the drawing-in are disposed below said second drive belt adjacent a lower part of said downwardly moving portion of the path of movement of said first drive belt.

6. Machine according to claim 5, wherein said means for controlling the thread during the drawing-in includes a thread-holding device having a thread-discharge slot covered by elastic means.

7. Machine according to claim 6, wherein said elastic means are bristles.

8. Machine according to claim 7, including a pneumatically operable member mounted below said first drive belt for opening the transport clamps.

9. Machine for drawing warp threads into a harness for a weaving machine from a warp-thread layer; said machine comprising a drawing-in member movable back and forth along a path; means for selecting individual warp threads of the warp-thread layer, a separating member for separating warp thread ends; and means for presenting the selected warp threads to said drawing-in member, said means for presenting the warp threads including a drivable transport clamp for transporting each separated warp thread end to a position to be received by said drawing-in member, a moveable guide element for controlling the thread during the transport operation, means for driving said guide element in timed relation to the movement of said transport clamp, means for holding the separated thread in a fixed position in the path of said drawing-in member, positioning means for positioning the separated thread, and means for controlling the thread during the drawing-in, said positioning means including two clamping pistons and a stop, said pistons being spaced apart from one another and mounted for adjustment relative to said stop so that, in a clamping position of said clamping pistons, an end portion of the thread is presented in a defined position to the drawing-in member.

10. Machine according to claim 9, wherein said clamping pistons are pneumatically operable plungers.

* * * * *